US011262098B2

(12) United States Patent
Teramoto et al.

(10) Patent No.: US 11,262,098 B2
(45) Date of Patent: Mar. 1, 2022

(54) INDOOR UNIT AND AIR-CONDITIONING APPARATUS

(71) Applicant: Mitsubishi Electric Corporation, Tokyo (JP)

(72) Inventors: Takuya Teramoto, Tokyo (JP); Takashi Ikeda, Tokyo (JP); Yasuaki Kato, Tokyo (JP); Ryo Horie, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 493 days.

(21) Appl. No.: 16/325,472

(22) PCT Filed: Oct. 30, 2017

(86) PCT No.: PCT/JP2017/039127
§ 371 (c)(1),
(2) Date: Feb. 14, 2019

(87) PCT Pub. No.: WO2018/079776
PCT Pub. Date: May 3, 2018

(65) Prior Publication Data

US 2019/0242612 A1 Aug. 8, 2019

(30) Foreign Application Priority Data

Oct. 31, 2016 (WO) ..... PCT/JP2016/082241

(51) Int. Cl.
*F24F 1/0025* (2019.01)
*F24F 13/08* (2006.01)
(Continued)

(52) U.S. Cl.
CPC ..... *F24F 13/08* (2013.01); *F04D 29/44* (2013.01); *F24F 1/0011* (2013.01);
(Continued)

(58) Field of Classification Search
CPC ..... F24F 13/08; F24F 1/0047; F24F 1/0011; F24F 1/0022; F24F 1/0025; F24F 1/0033;
(Continued)

(56) References Cited

U.S. PATENT DOCUMENTS 6,105,383 A 8/2000 Reimann et al.
2009/0145583 A1 6/2009 Han

FOREIGN PATENT DOCUMENTS

CN 1287927 A 3/2001
CN 101571139 A 11/2009
(Continued)

OTHER PUBLICATIONS

Office Action dated Dec. 11, 2020 issued in corresponding KR patent application No. 10-2019-7006330 (and English translation).
(Continued)

*Primary Examiner* — Edelmira Bosques
*Assistant Examiner* — Ryan L Faulkner
(74) *Attorney, Agent, or Firm* — Posz Law Group, PLC

(57) ABSTRACT

An indoor unit according to the present invention includes: an air-sending portion, which includes a casing having a rectangular air outlet and accommodating an impeller including a plurality of blades; a heat exchanger, which is configured to exchange heat with gas sent from the air-sending portion; and a guide portion, which includes an upper guide defining a passage for the gas and being arranged between an upper edge portion of the air outlet and an upper end portion of the heat exchanger and a lower guide defining a passage for the gas and being arranged between a lower edge portion of the air outlet and a lower end portion of the heat exchanger, and is open at side regions of the guide portion.

12 Claims, 10 Drawing Sheets

(51) Int. Cl.

| | |
|---|---|
| ***F24F 1/0033*** | (2019.01) |
| ***F24F 1/0047*** | (2019.01) |
| ***F24F 1/0022*** | (2019.01) |
| ***F24F 1/0011*** | (2019.01) |
| ***F04D 29/44*** | (2006.01) |

(52) U.S. Cl.
CPC ..... *F24F 1/0022* (2013.01); *F24F 1/0025* (2013.01); *F24F 1/0033* (2013.01); *F24F 1/0047* (2019.02); *F24F 13/081* (2013.01)

(58) Field of Classification Search
CPC .. F24F 13/081; F24F 13/082; F24F 2013/088; F04D 29/44
USPC ..... 454/233
See application file for complete search history.

(56) References Cited

FOREIGN PATENT DOCUMENTS

| | | | |
|---|---|---|---|
| JP | S54-036807 | U | 3/1979 |
| JP | S55-060139 | A | 5/1980 |
| JP | S57-137797 | U | 8/1982 |
| JP | S60-004822 | U | 1/1985 |
| JP | S62-062118 | U | 4/1987 |
| JP | S63-010309 | U | 1/1988 |
| JP | S63-168726 | U | 11/1988 |
| JP | H04-008016 | U | 1/1992 |
| JP | H06-58564 | A | 3/1994 |
| JP | H08-200722 | A | 8/1996 |
| JP | 2002-106945 | A | 4/2002 |
| JP | 2010-117110 | A | 5/2010 |
| JP | 2011-226407 | A | 11/2011 |
| KR | 10-2006-0026762 | A | 3/2006 |
| KR | 10-2009-0059234 | A | 6/2009 |

OTHER PUBLICATIONS

Chinese Office Action dated Mar. 1, 2021, issued in corresponding Chinese Patent Application No. 201780064743.7 (and English Machine Translation).

Decision of Rejection dated Jun. 25, 2021, issued in corresponding Korean Patent Application No. 10-2019-7006330 (and English Machine Translation).

Extended European Search Report dated Sep. 24, 2019 issued in corresponding EP patent application No. 17865380 4.

International Search Report of the International Searching Authority dated Jan. 30, 2018 for the corresponding International application No. PCT/JP2017/039127 (and English translation).

Office Action dated Jul. 26, 2018 issued in corresponding Taiwanese Patent Application No. 106109687 (and English translation).

Office Action dated Nov. 27, 2018 issued in corresponding Taiwanese Patent Application No. 106109687 (and English translation).

Office Action dated May 28, 2020 issued in corresponding CN patent application No. 201780064743.7 (and English translation).

Office Action dated Jun. 2, 2020 issued in corresponding KR patent application No. 10-2019-7006330 (and English translation).

Office Action dated Jun. 24, 2020 issued in corresponding IN patent application No. 201947014477 (and English translation).

Office Action dated Feb. 18, 2020 issued in corresponding JP patent application No. 2018-547826 (and English translation).

INDOOR UNIT AND AIR-CONDITIONING APPARATUS

CROSS REFERENCE TO RELATED APPLICATIONS

This application is a U.S. national stage application of International Application No. PCT/JP2017/039127, filed on Oct. 30, 2017, and is based on International Application No. PCT/JP2016/082241, filed on Oct. 31, 2016, the contents of which are incorporated herein by reference.

TECHNICAL FIELD

The present invention relates to an indoor unit and an air-conditioning apparatus including the same. In particular, the present invention relates to a structure for rectifying gas inside the indoor unit.

BACKGROUND

There has been disclosed, for example, an indoor unit for an air-conditioning apparatus, which includes a diffuser portion enlarged in a height direction and a width direction from an air outlet of each of spiral casings to the vicinity of a heat exchanger (see, for example, Patent Literature 1).

PATENT LITERATURE

Patent Literature 1: Japanese Unexamined Patent Application Publication No. 2010-117110

In the related-art ceiling-concealed indoor unit, a width of the heat exchanger is larger than widths of air outlets of an air-sending portion. Therefore, an air velocity distribution of air passing through the heat exchanger is non-uniform in the width direction. Therefore, a pressure loss in the heat exchanger is increased, with the result that, for example, degradation in efficiency of fans or increase in noise may occur. Further, in order to downsize the indoor unit, the heat exchanger is arranged obliquely relative to the air outlets of the spiral casings. Therefore, a distance between the air outlets of the spiral casings and the heat exchanger is increased. As a result, air streams discharged from the fans are influenced by a shape of a wall surface of an air passage in the unit, with the result that, for example, degradation in efficiency of the fans or increase in noise may occur.

For example, through application of the technology described in Patent Literature 1, a difference between the widths of the air outlets of the air-sending portion and the width of the heat exchanger, and a distance from discharge ports of the fans to the heat exchanger are reduced. However, air passages are sharply enlarged at enlarging portions of the diffusers. Therefore, air streams do not sufficiently spread along wall surfaces of the air passages, with the result that a pressure loss may adversely occur. Further, guides are provided to the diffusers so that air streams easily spread. However, there is a problem in that an improvement effect of the enlargement of the diffusers cannot be sufficiently obtained due to a pressure loss in the guides. Further, turbulence of an air stream occurs in a space between the adjacent spiral casings in air outlet passages of the spiral casings. Therefore, a vortex is liable to occur, with the result that a pressure loss may occur.

SUMMARY

The present invention has been made in view of the problems described above, and has an object to provide, for example, an indoor unit, which achieves further improvement in efficiency and reduction in noise.

According to one embodiment of the present invention, there is provided an indoor unit, including: an air-sending portion, which includes a casing having a rectangular air outlet and accommodating an impeller including a plurality of blades; a heat exchanger, which is configured to exchange heat with gas sent from the air-sending portion; and a guide portion, which includes an upper guide defining a passage for the gas and being arranged between an upper edge portion of the air outlet and an upper end portion of the heat exchanger, and a lower guide defining a passage for the gas and being provided between a lower edge portion of the air outlet and a lower end portion of the heat exchanger, and which is open at side regions of the guide portion.

Further, according to one embodiment of the present invention, an air-conditioning apparatus includes the indoor unit described above.

According to one embodiment of the present invention, gas sent from the air outlet of the air-sending portion to the heat exchanger is rectified so that the pressure loss can be reduced. Further, a vortex region generated in the vicinity of the air outlet of the air-sending portion can be reduced. Moreover, the side regions are open so that an air velocity distribution of gas flowing into the heat exchanger is uniform. Therefore, for example, further improvement in efficiency and reduction in noise can be attained.

DETAILED DESCRIPTION

Figure 1:
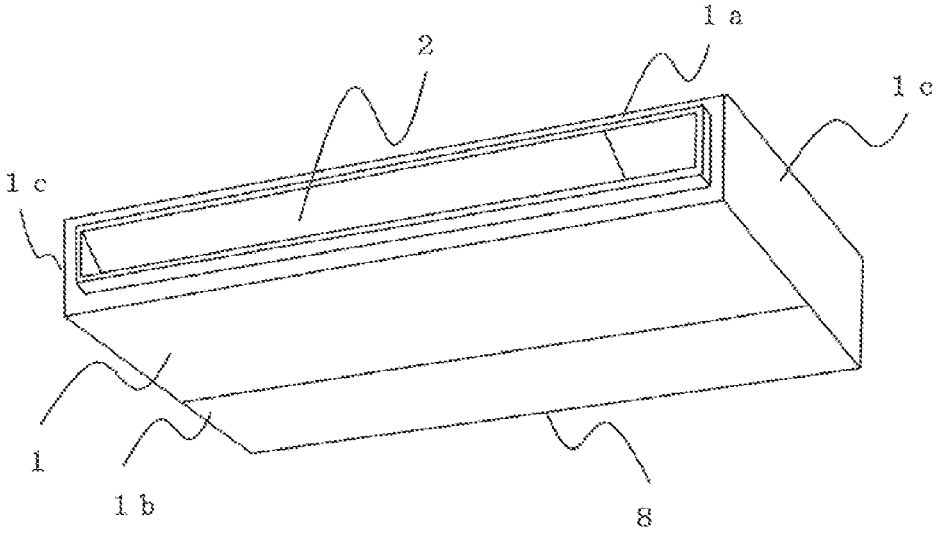
FIG. 1 is a perspective schematic view of an indoor unit according to Embodiment 1 of the present invention.

Now, an indoor unit and other apparatus according to embodiments of the present invention are described referring to the drawings. In the drawings referred to below, components denoted by the same reference symbols correspond to the same or equivalent components. This is common throughout the embodiments described below. Further, the forms of the components described herein are merely examples, and the components are not limited to the forms described herein. In particular, the combinations of the components are not limited to only the combinations in each embodiment, and the components described in another embodiment may be applied to still another embodiment. Further, in the following description, the upper part and the lower part of the drawings are referred to as "upper side" and "lower side", respectively. Further, for ease of understanding, terms indicating directions (for example, "right", "left", "front", and "rear") are used as appropriate. Those terms are used for description, but do not limit the invention of the present application. Further, in the drawings, the size relationship among components sometimes differs from actual relationships.

Embodiment 1

Figure 2:
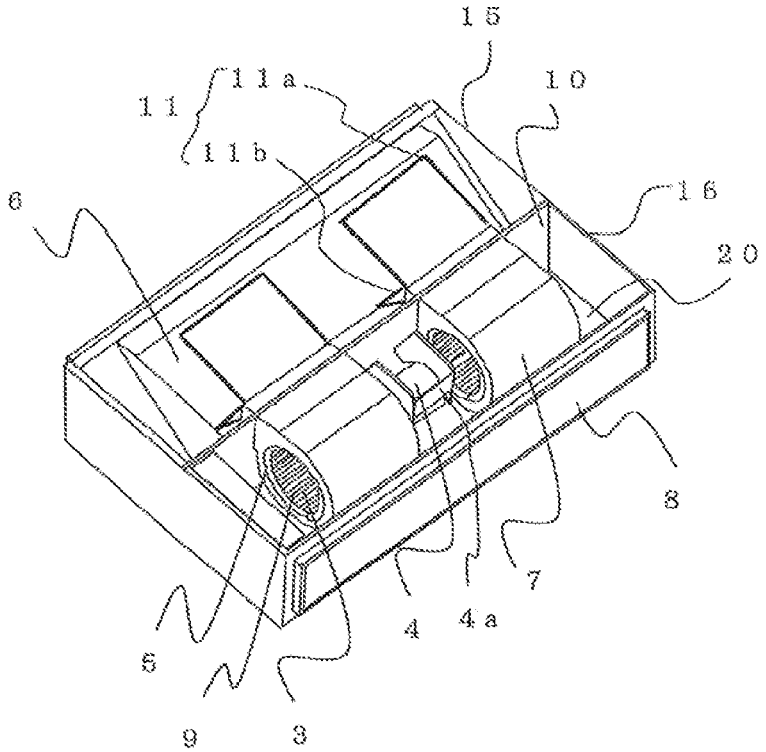
FIG. 2 is an explanatory schematic view of an internal structure of the indoor unit according to Embodiment 1 of the present invention.

FIG. 1 is a perspective schematic view of an indoor unit according to Embodiment 1 of the present invention. Further, FIG. 2 is an explanatory schematic view of an internal structure of the indoor unit according to Embodiment 1 of the present invention. The indoor unit according to Embodiment 1 is a device installed, for example, above a ceiling to, for example, heat, cool, humidify, or dehumidify a target space as an air-conditioning apparatus, a humidifier, a dehumidifier, a freezing machine, or other devices. The indoor unit according to Embodiment 1 is herein described as an indoor unit for an air-conditioning apparatus. Therefore, description is made assuming that gas is air.

As illustrated in FIG. 1 and FIG. 2, the indoor unit according to Embodiment 1 includes a case 1. As the shape of the case 1, any suitable shape may be employed. In this case, the case 1 has a rectangular cuboid shape as an example. The case 1 includes an upper surface portion 1*a*, a lower surface portion 1*b*, and a side surface portion 1*c*. The side surface portion 1*c* includes four surfaces. Further, the indoor unit is partitioned into a main body unit 15 and an air-sending unit 16 by a partition plate 10 described later as a boundary. The main body unit 15 and the air-sending unit 16 are combined with each other to form the indoor unit.

A case air-outlet 2 is formed on one surface side among the surfaces of the side surface portion 1*c* of the case 1. As the shape of the case air-outlet 2, any suitable shape may be employed. In this case, the case air-outlet 2 has a rectangular shape. Further, a case air-inlet 8 is formed in a surface on a side opposite to the surface having the case air-outlet 2 among the surfaces of the side surface portion 1*c* of the case 1. As the shape of the case air-inlet 8, any suitable shape may be employed. In this case, the case air-inlet 8 has a rectangular shape. Although not particularly limited, for example, a filter for removing dust from gas may be provided to the case air-inlet 8. In the indoor unit, the surface having the case air-outlet 2 is referred to as a front (front surface). Upward and downward directions as viewed from the front side are referred to as a height direction or an upper-and-lower direction. Further, right and left directions are referred to as a width direction or a rotation shaft direction, and front and rear directions are referred to as a front-and-rear direction or a depth direction.

In the case 1, there are accommodated an air-sending portion 20, a fan motor 4, and a heat exchanger 6. The heat exchanger 6 is arranged at a position in a passage of air from an air outflow side of the air-sending portion 20 to the case air-outlet 2. The heat exchanger 6 is configured to adjust at least one of a temperature or a humidity of air sent from the air-sending portion 20. In this case, the heat exchanger 6 has a rectangular shape in conformity with the shape of the case air-outlet 2. A configuration and a mode of the heat exchanger 6 are not particularly limited. The heat exchanger 6 in Embodiment 1 is not a special type, and a publicly-known type is used. For example, a fin-and-tube heat exchanger exchanges heat between air passing through the heat exchanger 6 and refrigerant passing through heat transfer pipes (not shown), to thereby adjust at least one of a temperature or a humidity of air.

The fan motor 4 and the air-sending portion 20 form an air-sending device. The fan motor 4 is driven through supply of electric power to rotate fans 3 inside spiral casings 7. The fan motor 4 is supported by, for example, a motor support 4*a* fixed to the upper surface portion 1*a* of the case 1. The fan motor 4 includes a rotation shaft X. The rotation shaft X is arranged to extend in parallel to the width direction along the surface having the case air-inlet 8 and the surface having the case air-outlet 2 among the surfaces of the side surface portion 1*c*.

The air-sending portion 20 in Embodiment 1 includes one or a plurality of spiral casings 7. As illustrated in FIG. 2, the indoor unit according to Embodiment 1 includes two spiral casings 7. Further, in each of the spiral casings 7, the multiblade and centrifugal fan 3 and a bellmouth 5 are installed. The fans 3 of the air-sending portion 20 are mounted to the rotation shaft X of the fan motor 4 described above. In the indoor unit illustrated in FIG. 2, the two fans 3 of the spiral casings 7 are mounted to the rotation shaft X in parallel with each other. Therefore, the two fans 3 and the two spiral casings 7 are arrayed in the width direction. In this case, description is made assuming that the air-sending portion 20 includes the two spiral casings 7 and the two fans 3. However, the number of the spiral casings 7 and the fans 3 to be installed is not limited.

Figure 3:
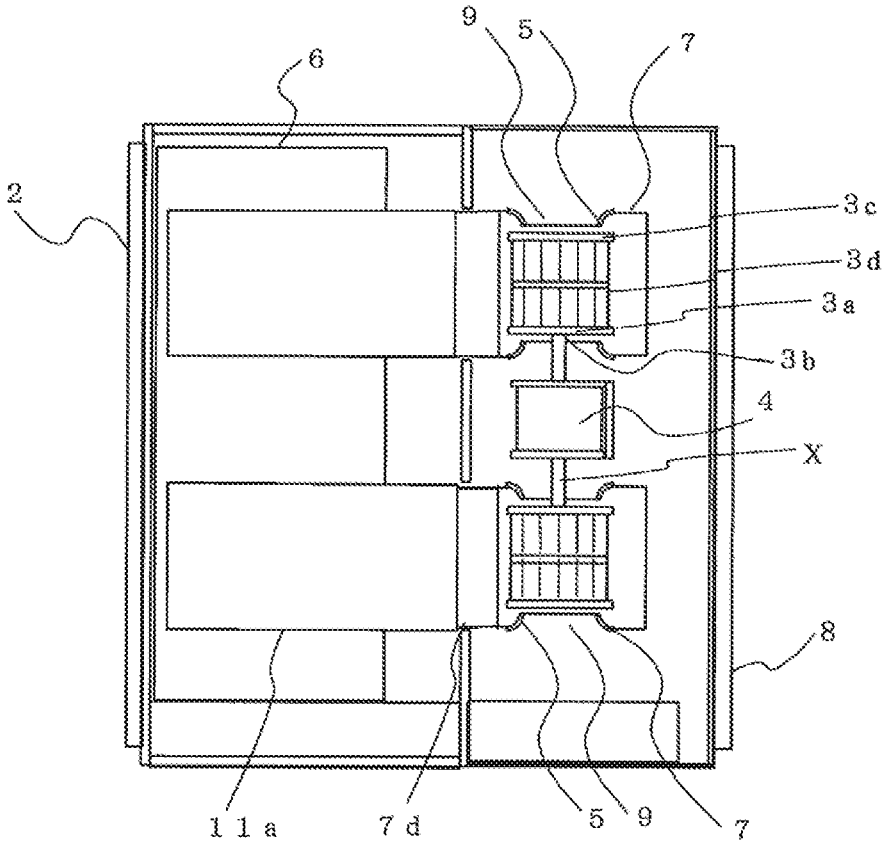
FIG. 3 is an explanatory (first) view of the indoor unit for an air-conditioning apparatus according to Embodiment 1 of the present invention.
Figure 4:
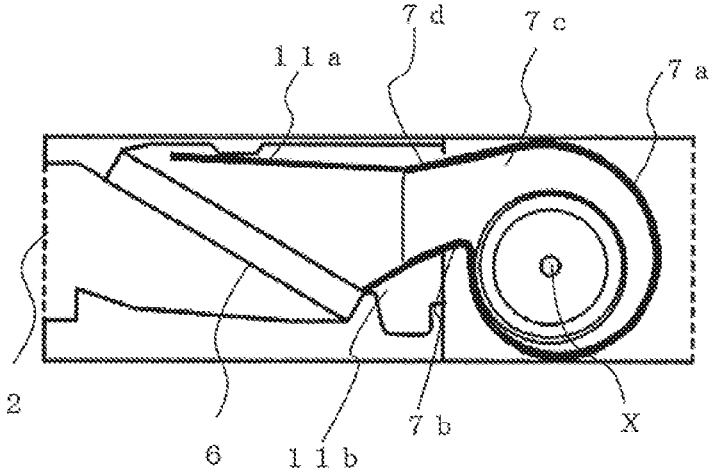
FIG. 4 is an explanatory (second) view of the indoor unit for an air-conditioning apparatus according to Embodiment 1 of the present invention.
Figure 5:
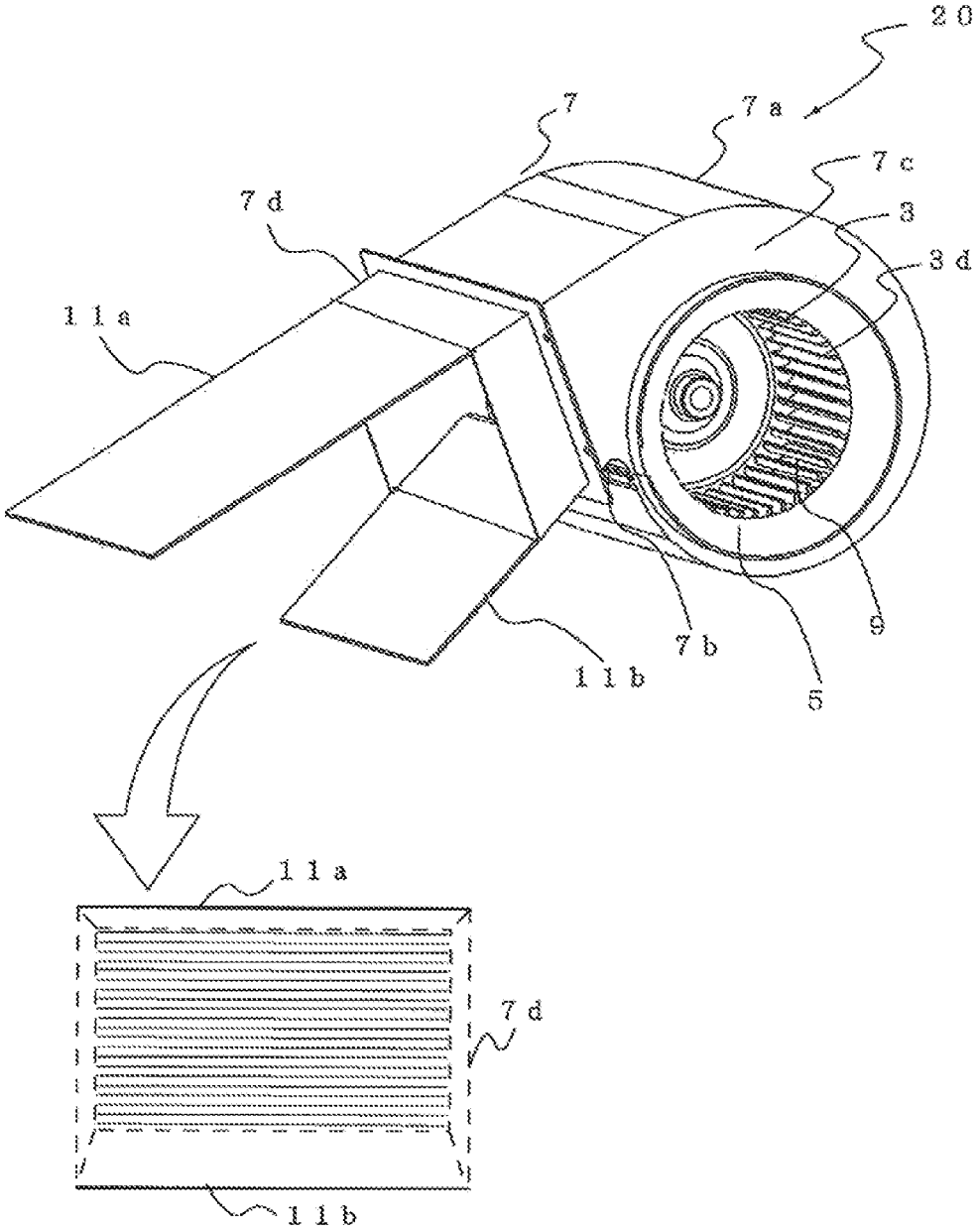
FIG. 5 is a perspective view of an air-sending portion 20 of the indoor unit for an air-conditioning apparatus according to Embodiment 1 of the present invention.

FIG. 3 and FIG. 4 are each an explanatory view of the indoor unit for an air-conditioning apparatus according to Embodiment 1 of the present invention. FIG. 3 is an illustration of the internal structure of the indoor unit as viewed from top of the main body unit. Further, FIG. 4 is an illustration of the internal structure of the indoor unit when the indoor unit is viewed in the rotation shaft direction. Moreover, FIG. 5 is a perspective view of the air-sending portion 20 of the indoor unit for an air-conditioning apparatus according to Embodiment 1 of the present invention.

The fans 3 of the air-sending portion 20 each serve as an impeller configured to generate flow of air that is sucked into the case 1 through the case air-inlet 8 and blown out into a target space through the case air-outlet 2. The fans 3 each include a main plate 3*a*, a side plate 3*c*, and a plurality of blades 3*d*. The main plate 3*a* has a disc shape, and includes a boss portion 3*b* at a center portion thereof. The rotation shaft X of the fan motor 4 is connected to the center of the boss portion 3*b*. The fans 3 are rotated through drive of the fan motor 4. A rotation direction of the fans 3 corresponds to the height direction (upper-and-lower direction). The side plate 3*c* is provided to be opposed to the main plate 3*a*, and has a ring shape. A hole of the ring of the side plate 3*c* serves an inflow port into which air flows through the bellmouth 5. The plurality of blades 3*d* are provided between the main plate 3*a* and the side plate 3*c* to surround the rotation shaft X. The plurality of blades 3*d* have the same shape. The blades 3*d* are each formed of a forward curved vane in which a blade trailing edge on an outer peripheral side is located forward in the rotation direction relative to a blade leading edge on an inner peripheral side.

The spiral casings (scroll casings) 7 are each configured to receive the fan 3 to surround the fan 3. The spiral casing 7 is configured to rectify air having been blown out from the fan 3. The spiral casing 7 includes a peripheral wall 7*a* extending along an outer peripheral end of the fan 3. The peripheral wall 7*a* includes a tongue portion 7*b* at one portion. An end portion of a portion protruding from the peripheral wall 7*a* relative to a portion corresponding to the tongue portion 7*b* serves as a fan air-outlet 7*d*. Through rotation of the fan 3, air flows through the fan 3 to be sent from the fan air-outlet 7*d*. The fan air-outlet 7*d* has a rectangular shape. The fan air-outlet 7*d* that serves as an air outlet of the air-sending portion 20 is opened toward the heat exchanger 6 and the case air-outlet 2. Therefore, air having been blown out from the air-sending portion 20 generally flows in a direction toward the heat exchanger 6 and the case air-outlet 2.

Further, at least one fan air-inlet 9 is formed in a side wall 7*c* of the spiral casing 7. The bellmouth 5 is arranged along the fan air-inlet 9. The bellmouth 5 is configured to rectify air flowing into the fan 3. The bellmouth 5 is positioned to face the inflow port for air of the fan 3. The partition plate 10 is a plate for partitioning a space between the fan air-inlets 9 and the fan air-outlets 7*d*. The fan air-inlets 9 of the spiral casings 7 are located in a space on the air-sending unit 16 side, and the fan air-outlets 7*d* of the spiral casings 7 are located in a space on the main body unit 15 side.

The indoor unit according to Embodiment 1 includes guide portions 11. The guide portions 11 each serve as a wall for guiding air sent from the fan air-outlet 7*d* of the spiral casing 7 to the heat exchanger 6. In this case, guides are provided at upper and lower edges of the fan air-outlet 7*d* that intersect the height direction being the rotation direction of the fan 3. In Embodiment 1, an upper guide 11*a* and a lower guide 11*b* are provided. The upper guide 11*a* and the lower guide 11*b* are formed not merely by extending the upper edge and the lower edge of the fan air-outlet 7*d* along an orientation of the fan air-outlet 7*d*, but are installed to enlarge the fan air-outlet 7*a* from the upper edge portion and the lower edge portion of the fan air-outlet 7*d* of the spiral casing 7 toward an upper end portion and a lower end portion of the heat exchanger 6. FIG. 5 is an illustration of a relationship between the fan air-outlet 7*d* and an end surface of the guide portion 11 when the air-sending portion 20 is viewed from the fan air-outlet 7*d* side. With this, air sent from the fan air-outlet 7*d* can be rectified while increasing air volume. Further, edges do not extend along the height direction, the height direction being substantially equal to the rotation direction of the fan 3 viewed in the direction of front-back direction of the fan. That is, there are no extensive guides along the upper and lower guides 11*a* and 11*b* in so that the lateral side is open.

For example, although it is advantageous to close the side regions when air is to be guided in a set direction, air flowing along the wall is to be blown out while being sharply spread in the width direction after passing along the wall. Therefore, the air flowing into the heat exchanger 6 differs in air velocity in the width direction so that an airflow velocity distribution is not uniform. In contrast, in the indoor unit according to Embodiment 1, walls on the side regions of the guide portion 11 are not extended, and the side regions are opened. Therefore, air having been blown out from the fan air-outlet 7*d* of the spiral casing 7 spreads evenly in the width direction without stagnation. Thus, the air velocity distribution of air, which flows into the heat exchanger 6, in the width direction is expected to become uniform. A material of the upper guide 11*a* and the lower guide 11*b* that form the guide portion 11 is not limited. For example, a material such as polystyrene foam may be employed. Further, the guide portion 11 may have any shape in an extension direction when the guide portion 11 extends toward the upper end portion and the lower end portion of the heat exchanger 6.

Next, description is made of flow of air when the fans 3 of the air-sending portion 20 are rotated. When electric power is supplied, the fan motor 4 is driven so that the fans 3 are rotated. When the fans 3 are rotated, for example, air in a room to be air-conditioned flows into the case 1 through the case air-inlet 8. Air having been sucked into the case 1 passes through the fan air-inlets 9 of the spiral casings 7, and is guided by the bellmouths 5 to flow into the fans 3. Further, the air having flowed into the fans 3 is blown out in a radial direction and an outward direction of the fans 3. The air having been blown out from the fans 3 passes through the spiral casings 7, and then, is blown out through the fan air-outlets 7*d* of the spiral casings 7. The air having been blown out passes through the heat exchanger 6. The air supplied to the heat exchanger 6 exchanges heat when passing through the heat exchanger 6 to be adjusted in humidity. After that, the air is blown out to the outside of the case 1 through the case air-outlet 2.

In the indoor unit according to Embodiment 1, the air having been blown out from each of the fan air-outlets 7*d* of the spiral casings 7 flows along the guide portion 11. The guide portion 11 extending to the heat exchanger 6 is provided. Thus, the air having been blown out flows in the depth direction to reach the heat exchanger 6 without being influenced by the shape of the case 1 and being separated from the upper guide 11*a* and the lower guide 11*b*. Further, the air having been blown out through the fan air-outlet 7*d* evenly spreads in the width direction. Therefore, the air velocity can be uniform. As described above, the influence of the shape of the case 1 can be suppressed. Further, an air vortex can be prevented from being generated, for example, in the vicinities of the partition plate 10 and the fan air-outlets 7*d*.

With the spiral casings 7 in Embodiment 1 each having the configuration described above, the passing air velocity in the heat exchanger 6 is uniformized to suppress a vortex region in the vicinity of the fan air-outlet 7*d*. Thus, a pressure loss caused by turbulence of an air stream can be reduced so that improvement in efficiency and reduction in noise can be attained due to improvement in air volume and static pressure effect.

Embodiment 2

Figure 6:
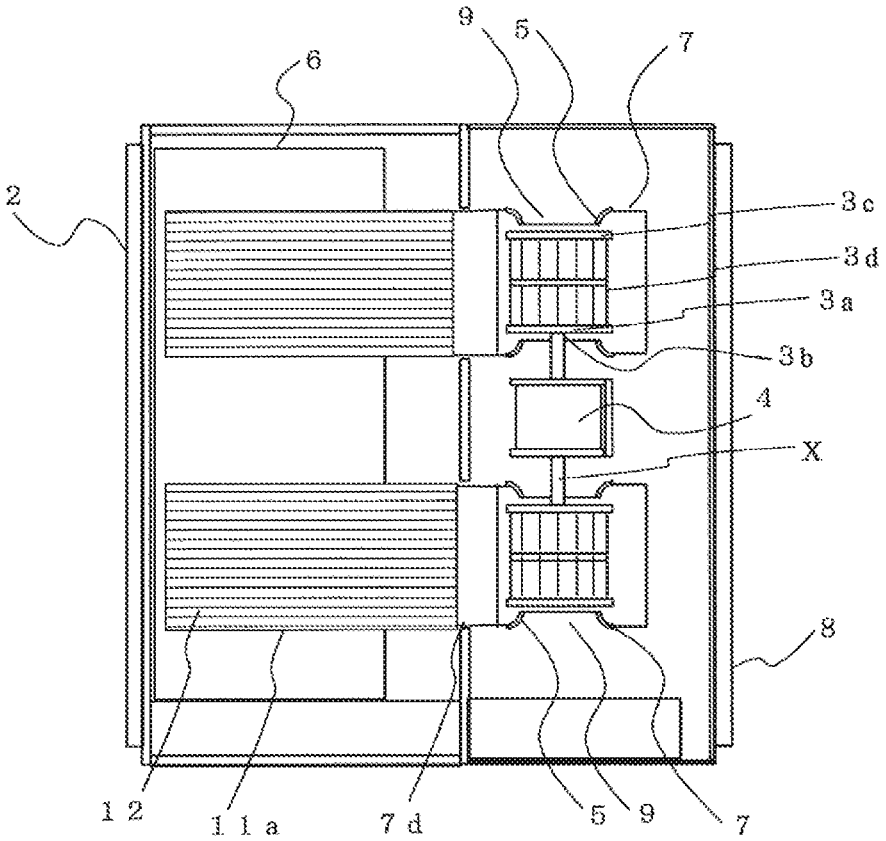
FIG. 6 is an explanatory view of an indoor unit for an air-conditioning apparatus according to Embodiment 2 of the present invention.

FIG. 6 is an explanatory view of an indoor unit for an air-conditioning apparatus according to Embodiment 2 of the present invention. FIG. 6 is an illustration of an internal structure of the indoor unit as viewed from the upper surface side. Next, with reference to FIG. 6, description is made of the indoor unit according to Embodiment 2 of the present invention.

In the indoor unit according to Embodiment 1 described above, the upper guide 11*a* and the lower guide 11*b* are provided at the upper and lower portions of the air outlet of each of the spiral casings 7 so that the air having been blown out from each of the spiral casings 7 is guided to the upper and lower end portions of the heat exchanger 6. In the indoor unit according to Embodiment 2, a wall surface of an air passage in the guide portion 11 extended from each of the spiral casings 7 has protrusions and depressions. In this case, the guide portion 11 has ribs 12. The ribs 12 in FIG. 6 each have a rectangular parallelepiped shape. The ribs 12 in Embodiment 2 are formed to extend along the depth direction in which air flows through rotation of the fan 3. Therefore, air flowing from the spiral casing 7 to the heat exchanger 6 can further be rectified along the wall surface of the guide portion 11. In this case, the ribs 12 are formed, but, for example, grooves may be formed.

Figure 7:
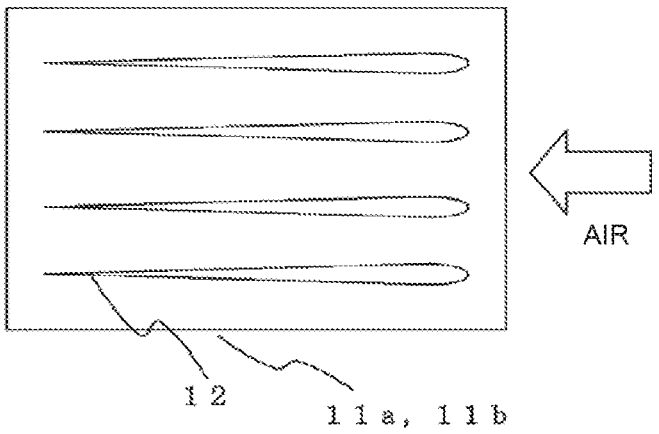
FIG. 7 is a (first) view for illustrating shapes of ribs 12 of a guide portion 11 in Embodiment 2 of the present invention.
Figure 8:
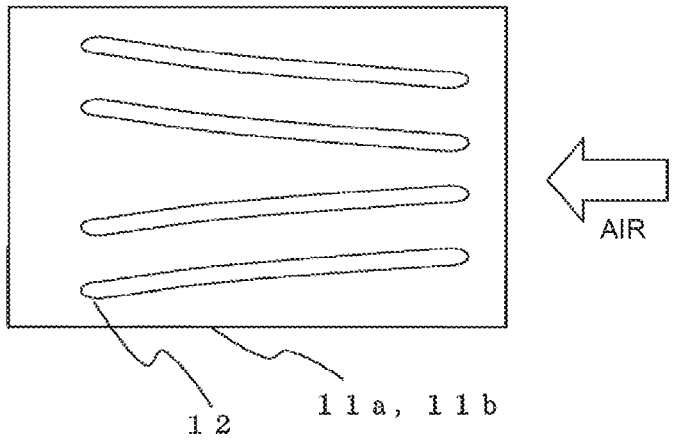
FIG. 8 is a (second) view for illustrating shapes of the ribs 12 of the guide portion 11 in Embodiment 2 of the present invention.

FIG. 7 and FIG. 8 are each a view for illustrating the shapes of the ribs 12 of the guide portion 11 in Embodiment 2 of the present invention. In FIG. 6 referred to above, the ribs 12 each having a rectangular cuboid shape are illustrated. However, the shape of each of the ribs 12 is not limited thereto. For example, as illustrated in FIG. 7, the ribs 12 may each have a streamline shape. Further, as illustrated in FIG. 8, the ribs 12 may each have an arc shape.

As described above, in the indoor unit according to Embodiment 2, the guide portion 11 has the ribs 12. Thus, flow of air in the guide portion 11 can be rectified. Therefore, in addition to the effects described in Embodiment 1, separation of an air stream can be prevented in the air passage on the air outlet side in the spiral casing 7. Therefore, a pressure loss can be reduced so that improvement in efficiency and reduction in noise can be attained due to improvement in air volume and static pressure effect.

Embodiment 3

Figure 9:
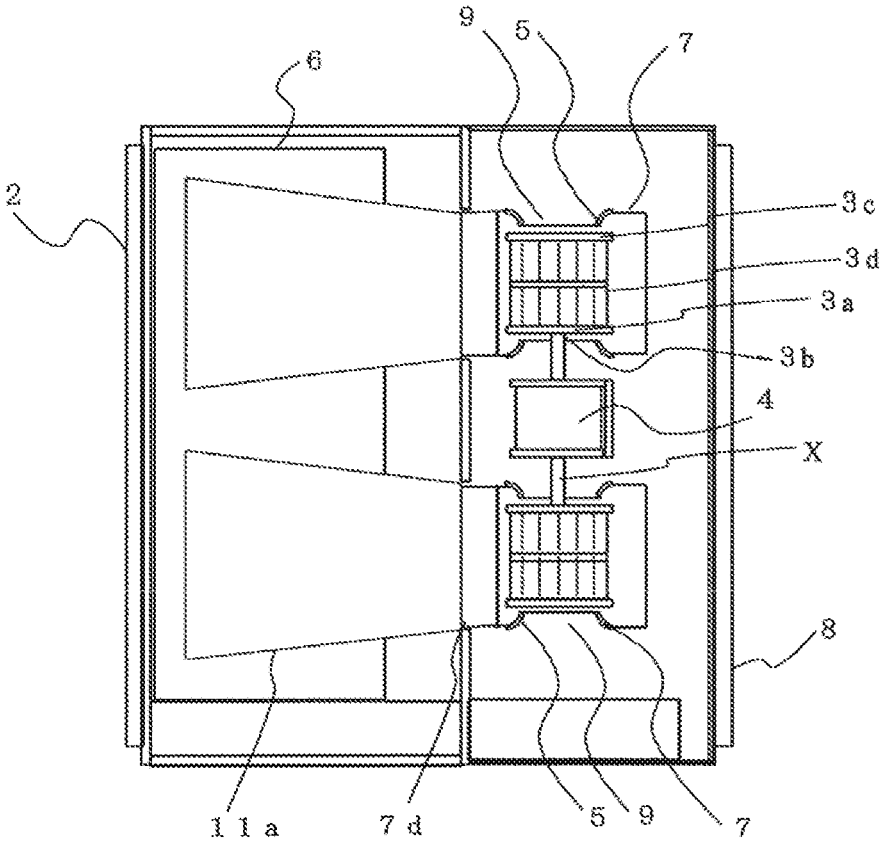
FIG. 9 is an explanatory view of an indoor unit for an air-conditioning apparatus according to Embodiment 3 of the present invention.

FIG. 9 is an explanatory view of an indoor unit for an air-conditioning apparatus according to Embodiment 3 of the present invention. FIG. 9 is an illustration of an internal structure of the indoor unit as viewed from the upper surface side. Next, with reference to FIG. 9, description is made of the indoor unit according to Embodiment 3 of the present invention.

In the indoor unit according to Embodiment 1 described above, the guide portion 11 is provided at the upper and lower portions of the air outlet of each of the spiral casings 7 so that the air having been blown out from each of the spiral casings 7 is guided to the upper and lower end portions of the heat exchanger 6. The wall of the guide portion 11 in the indoor unit according to Embodiment 1 is parallel to the depth direction from the fan air-outlet 7*d* side to the heat exchanger 6 side.

In the indoor unit according to Embodiment 3, the wall of the guide portion 11 has a shape enlarged in the width (lateral) direction being a direction toward the side wall 7*c* from the air outlet side toward the heat exchanger 6 side. Therefore, air flowing out from the spiral casing 7 can be sufficiently spread. Further, the air velocity distribution of air, which passes through the heat exchanger 6, in the width direction can further be uniform.

The outer peripheral portion enlarged in the side wall direction may be gradually enlarged in, for example, an arc shape. Further, an angle formed when the outer peripheral portion is enlarged is not limited, and, for example, the outer peripheral portion may be sharply enlarged.

As described above, in the indoor unit according to Embodiment 3, the wall of the guide portion 11 has a shape enlarged in the direction toward the side wall 7*c* from the air outlet side toward the heat exchanger 6 side. Thus, the air velocity distribution of air, which passes through the heat exchanger 6, in the width direction can be uniform. Therefore, in addition to the effects described in Embodiment 1, a vortex region can further be suppressed in the air passage on the air outlet side in the spiral casing 7. Therefore, improvement in efficiency and reduction in noise can be attained due to improvement in air volume and static pressure effect.

Embodiment 4

Figure 10:
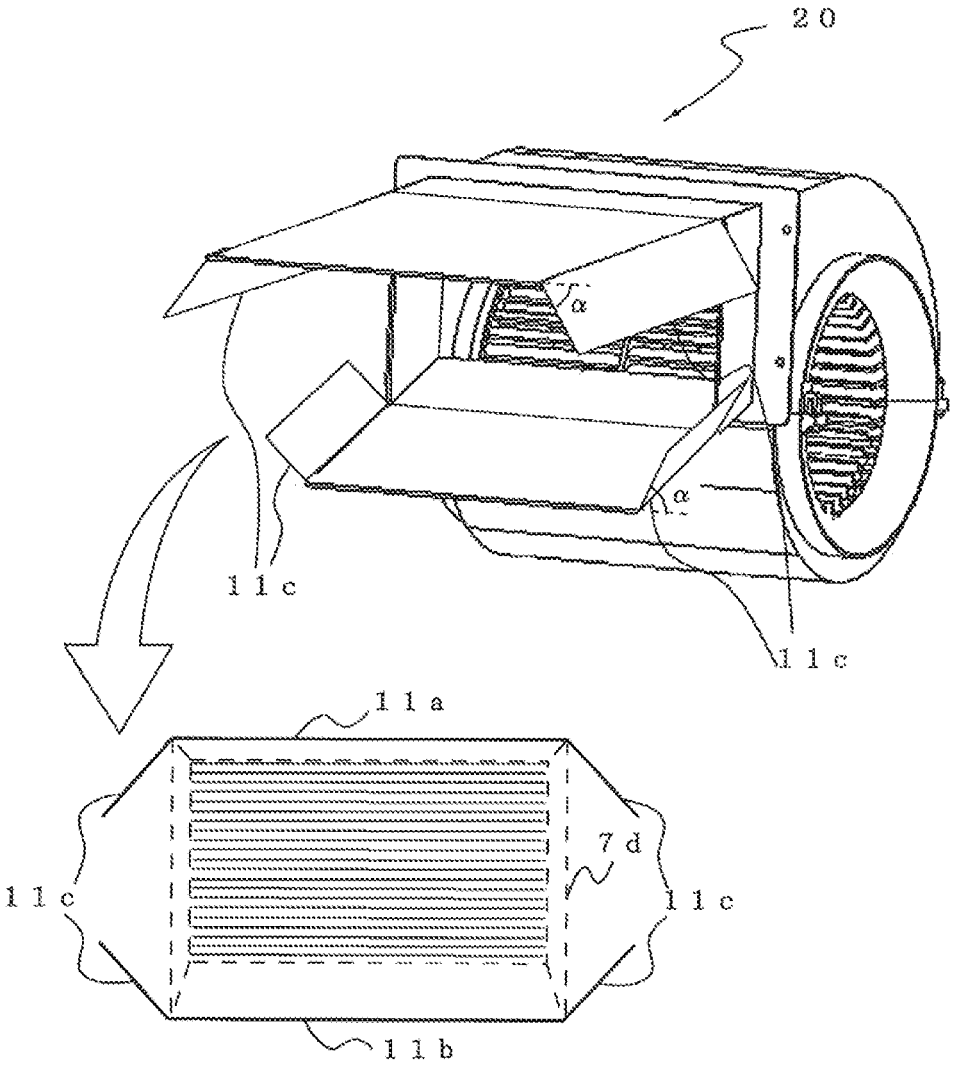
FIG. 10 is an explanatory view of the air-sending portion 20 of an indoor unit for an air-conditioning apparatus according to Embodiment 4 of the present invention.

FIG. 10 is an explanatory view of the air-sending portion 20 of an indoor unit for an air-conditioning apparatus according to Embodiment 4 of the present invention. Next, with reference to FIG. 10, description is made of the indoor unit according to Embodiment 4 of the present invention.

The upper guide 11*a* and the lower guide 11*b* of the guide portion 11 in the indoor unit according to Embodiment 4 each include lateral inclined portions 11*c* being inclined portions, which are formed by bending end portions in the lateral direction thereof. The lateral inclined portions 11*c* are formed by, for example, bending the end portions in the lateral direction of the upper guide 11*a* and the lower guide 11*b*. FIG. 10 is an illustration of a relationship between the fan air-outlet 7*d* and the end surface of the guide portion 11 when the air-sending portion 20 is viewed from the fan air-outlet 7*d* side.

Also in the guide portion 11 in Embodiment 4, the side regions are not closed by the lateral inclined portions 11*c* but are opened. Further, the lateral inclined portions 11*c* are not perpendicular to the height direction, but each have an inclination. When the end portions in the lateral direction are formed to erect vertically, flow of air that spreads in the width direction is blocked, with the result that, for example, air velocity of air flowing into the heat exchanger 6 may not be uniform. It is preferred that an inclination angle $\alpha$ be 50 degrees or less.

Further, the upper guide 11*a* and the lower guide 11*b* may be equal to each other or different from each other in, for example, inclination angle a and length of each of the lateral inclined portions 11*c*. Further, the shape of each of the lateral inclined portions 11*c* is not particularly limited. Further, any one of the upper guide 11*a* and the lower guide 11*b* may have the lateral inclined portions 11*c*.

As described above, in the air-conditioning apparatus according to Embodiment 4, the upper guide 11*a* and the lower guide 11*b* each include the lateral inclined portions 11*c*. Thus, separation of an air stream in the direction toward the side wall 7*c* can be reduced. Therefore, in addition to the effects described in Embodiment 1 to Embodiment 3, a pressure loss can further be reduced so that improvement in efficiency and reduction in noise can be attained due to improvement in air volume and static pressure effect.

Embodiment 5

Figure 11:
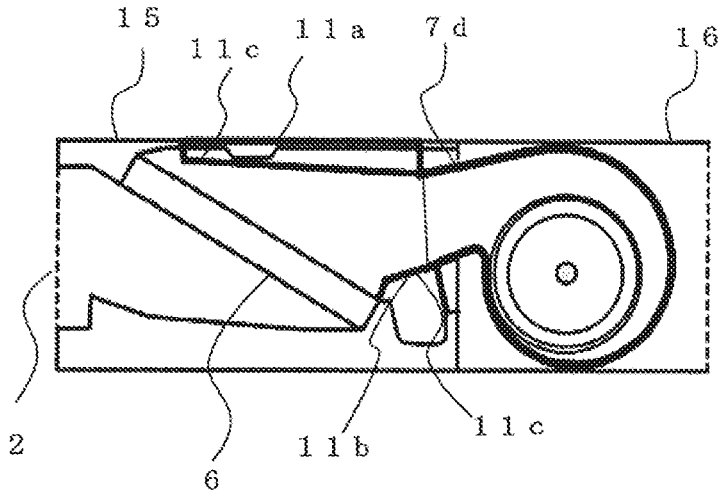
FIG. 11 is an explanatory view of an indoor unit for an air-conditioning apparatus according to Embodiment 5 of the present invention.

FIG. 11 is an explanatory view of an indoor unit for an air-conditioning apparatus according to Embodiment 5 of the present invention. FIG. 11 is an illustration of an internal structure of the indoor unit as viewed from the width direction side. Next, with reference to FIG. 11, description is made of the air-conditioning apparatus according to Embodiment 5 of the present invention.

For example, in the air-conditioning apparatus according to Embodiment 1, as illustrated in FIG. 5, the guide portion 11 is mounted to the spiral casing 7 to be integrated. However, the present invention is not limited thereto. In particular, in a case in which at least one of the upper guide 11*a* or the lower guide 11*b* of the guide portion 11 has a shape enlarged in the direction toward the side wall 7*c* from the air outlet side toward the heat exchanger 6 side as in Embodiment 3, when the indoor unit is to be manufactured, the guide portion 11 cannot be caused to pass through the partition plate 10. Therefore, after the tongue portion 7*b* of the spiral casing 7 is caused to pass through the partition plate 10, the portion being the guide portion 11 is to be mounted. Further, it is difficult to integrally form the air-sending portion 20.

In view of this, in the air-conditioning apparatus according to Embodiment 5, the guide portions 11 are mounted to an inner wall of the case 1 on the main body unit 15 side so that the guide portions 11 are accommodated on the main body unit 15 side. Further, when the main body unit 15 and the air-sending unit 16 are to be combined with each other, the tongue portions 7*b* and the guide portions 11 are joined to each other. The guide portions 11 may be formed integrally with the partition plate 10 or other portions.

As described above, in the air-conditioning apparatus according to Embodiment 5, the guide portions 11 are formed on the main body unit 15 side so that assembly of the indoor unit that achieves the effects in Embodiment 1 to Embodiment 4 can easily be carried out.

Embodiment 6

Figure 12:
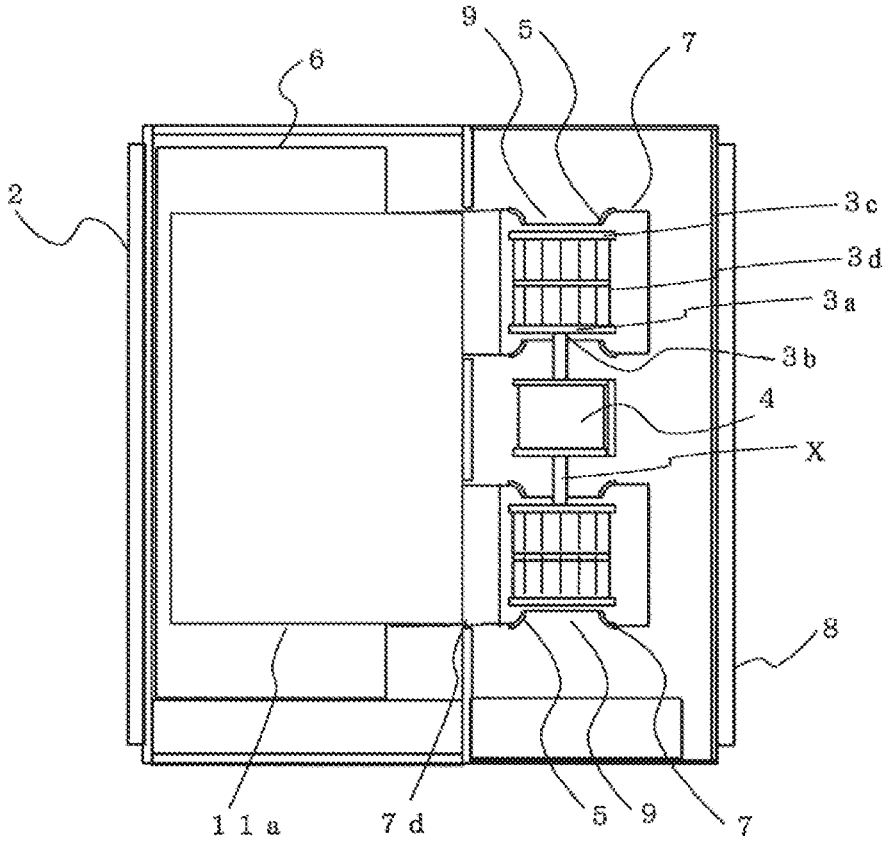
FIG. 12 is an explanatory view of an indoor unit for an air-conditioning apparatus according to Embodiment 6 of the present invention.

FIG. 12 is an explanatory view of an indoor unit for an air-conditioning apparatus according to Embodiment 6 of the present invention. FIG. 12 is an illustration of an internal structure of the indoor unit as viewed from the upper surface side. In Embodiment 1 to Embodiment 5 described above, the upper guide 11*a* and the lower guide 11*b* of the guide portion 11 are mounted to each of the spiral casings 7. However, the present invention is not limited thereto. For example, the common upper guide 11*a* and the common lower guide 11*b* may be mounted to the plurality of spiral casings 7.

Further, in Embodiment 1 to Embodiment 5 described above, description is made assuming that the heat exchanger 6 is a fin-and-tube heat exchanger. However, the present invention is not limited thereto. For example, in order to humidify air, a humidification member configured to allow water to drip is provided as a heat exchanger.

Embodiment 7

Figure 13:
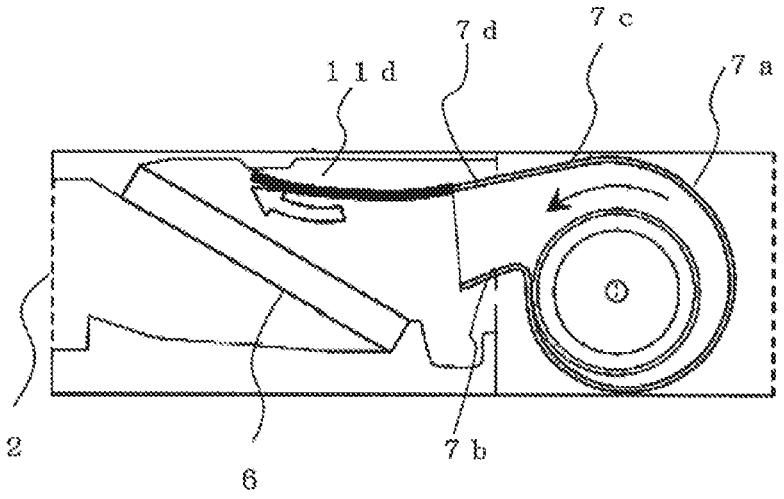
FIG. 13 is an explanatory view of an indoor unit for an air-conditioning apparatus according to Embodiment 7 of the present invention.

FIG. 13 is an explanatory view of an indoor unit for an air-conditioning apparatus according to Embodiment 7 of the present invention. FIG. 13 is an illustration of an internal structure of the indoor unit when the indoor unit is viewed in the rotation shaft direction. In the indoor unit according to Embodiment 1, as illustrated in FIG. 4, in the guide portion 11 defining the passage of air from the fan air-outlet 7*d* to the heat exchanger 6, the upper guide 11*a* being a wall having a leading surface for leading air on the upper side has a linear shape in the extension direction extending toward the heat exchanger 6 side.

The indoor unit according to Embodiment 7 includes upper guides 11*d* in place of the upper guides 11*a*. As illustrated in FIG. 13, the upper guide 11*d* has a shape, which protrudes downward from the fan air-outlet 7*d* toward the heat exchanger 6, in the extension direction. Therefore, the leading surface being the wall of the upper guide 11*d* is a curved surface that warps from the lower side to the upper side in the course of extending from the fan air-outlet 7*d* toward the heat exchanger 6.

As in the indoor unit according to Embodiment 7, the upper guide 11*d* has a shape, which protrudes downward in the course of extending from the fan air-outlet 7*d* toward the heat exchanger 6, in the extension direction. Thus, the wall surface extends continuously with the fan air-outlet 7*d* and the upper guide 11*d*. Therefore, an abrupt spread loss of air blown out from the fan air-outlet 7*d* can be reduced.

Further, in the indoor unit according to Embodiment 7, the upper guide 11*d* has a shape, which protrudes downward, in the extension direction. Thus, air sent from the fan air-outlet 7*d* can be guided upward. As illustrated in FIG. 13, when the spiral casing 7 is installed under a state of being turned in a fan rotation direction (in a counterclockwise direction in FIG. 13), an orientation of the fan air-outlet 7*d* at the upper edge portion corresponds to an orientation extending downward relative to the horizontal direction. In the indoor unit according to Embodiment 7, even when the upper edge portion of the fan air-outlet 7*d* is oriented downward relative to the horizontal direction, the upper guide 11*d* guides air upward along the wall surface so that the air can be sent to the upper end portion of the heat exchanger 6. Therefore, unevenness of the air velocity distribution of air flowing into the heat exchanger 6 can be maintained to be smaller than in a case in which the leading surface is not provided at the upper portion.

Embodiment 8

Figure 14:
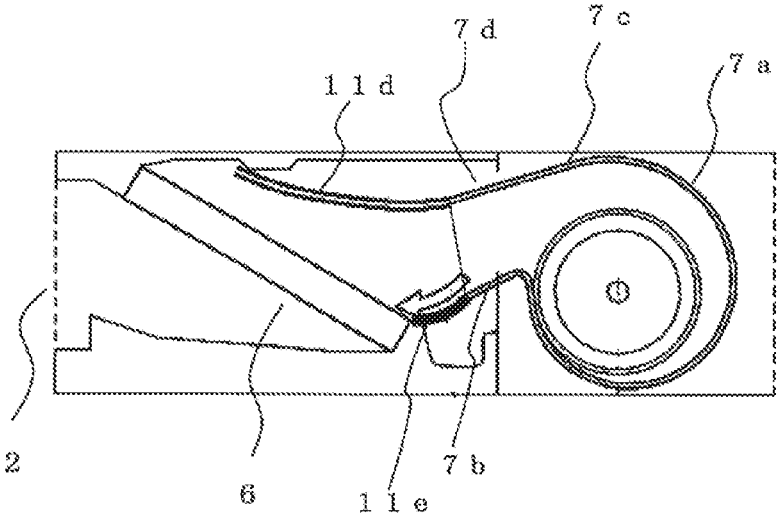
FIG. 14 is an explanatory view of an indoor unit for an air-conditioning apparatus according to Embodiment 8 of the present invention.

FIG. 14 is an explanatory view of an indoor unit for an air-conditioning apparatus according to Embodiment 8 of the present invention. FIG. 14 is an illustration of an internal structure of the indoor unit when the indoor unit is viewed in the rotation shaft direction. In the indoor unit according to Embodiment 1, as illustrated in FIG. 4, in the guide portion 11 defining the passage of air from the fan air-outlet 7*d* to the heat exchanger 6, the lower guide 11*b* being a wall having a leading surface for leading air on the lower side has a linear shape in the extension direction extending toward the heat exchanger 6 side.

The indoor unit according to Embodiment 8 includes lower guides 11*e* in place of the lower guides 11*b*. As illustrated in FIG. 14, the lower guide 11*e* has a shape, which protrudes downward from the fan air-outlet 7*d* toward the heat exchanger 6, in the extension direction. Therefore, the leading surface being the wall of the lower guide 11*e* is a curved surface that warps from the lower side to the upper side in the course of extending from the fan air-outlet 7*d* toward the heat exchanger 6.

As in the indoor unit according to Embodiment 8, the lower guide 11*e* has a shape, which protrudes downward in the course of extending from the fan air-outlet 7*d* toward the heat exchanger 6, in the extension direction. Thus, the wall surface extends continuously with the fan air-outlet 7*d* and the lower guide 11*e*. Therefore, an abrupt spread loss of air blown out from the fan air-outlet 7*d* can be reduced.

Further, in the indoor unit according to Embodiment 8, the lower guide 11*e* has a shape, which protrudes downward, in the extension direction. Thus, air sent from the fan air-outlet 7*d* can be guided upward. As illustrated in FIG. 14, when the spiral casing 7 is installed under a state of being turned in the fan rotation direction (in the counterclockwise direction in FIG. 14), an orientation of the fan air-outlet 7*d* at the lower edge portion corresponds to an orientation extending downward with respect to a direction toward the heat exchanger 6 side. In the indoor unit according to Embodiment 8, even when the lower edge portion of the fan air-outlet 7*d* is oriented downward with respect to the direction toward the heat exchanger 6 side, the lower guide 11*e* guides air upward along the wall surface so that the air can be sent to the lower end portion of the heat exchanger 6. Therefore, unevenness of the air velocity distribution of air flowing into the heat exchanger 6 can be maintained to be smaller than in a case in which the leading surface is not provided at the lower portion.

Embodiment 9

Figure 15:
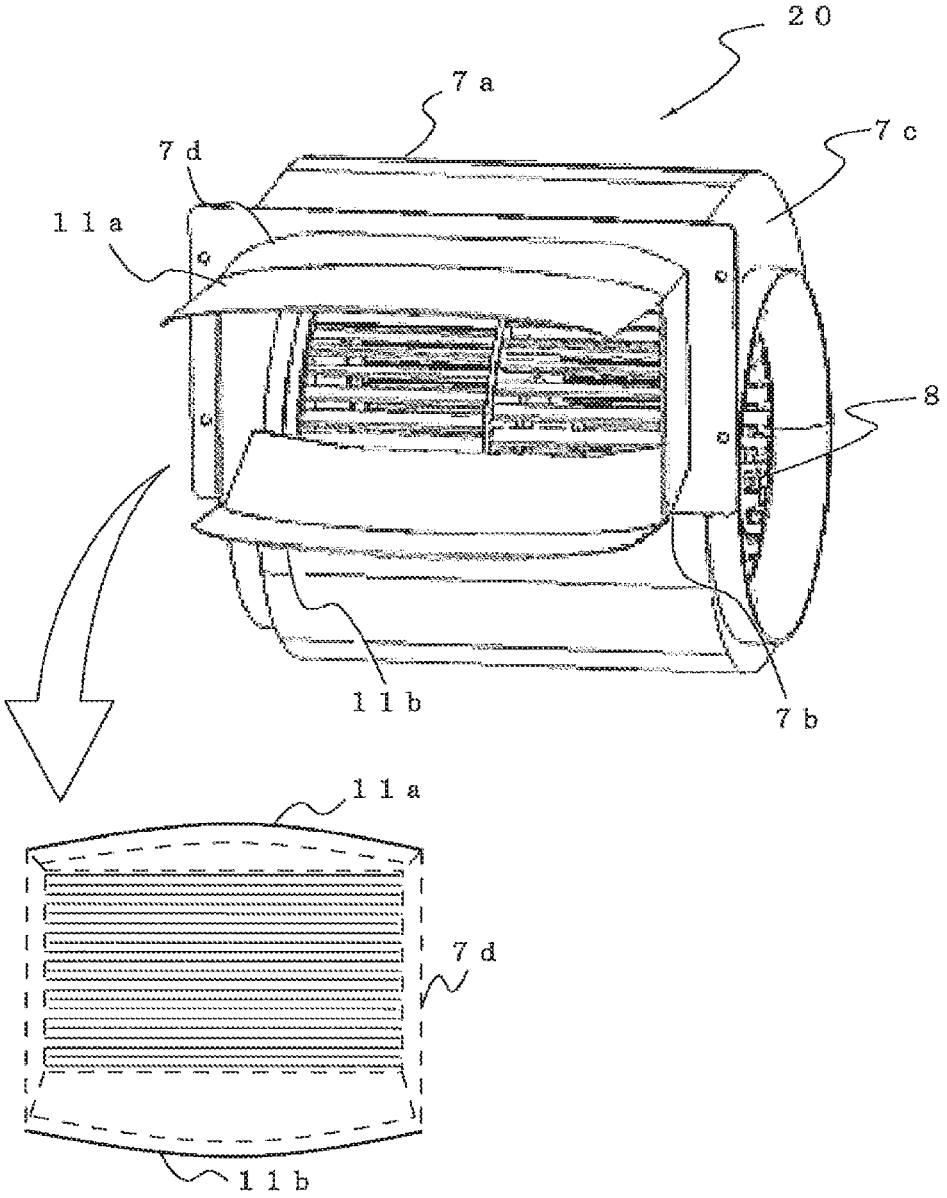
FIG. 15 is an explanatory view of the air-sending portion 20 of an indoor unit for an air-conditioning apparatus according to Embodiment 9 of the present invention.

FIG. 15 is an explanatory view of the air-sending portion 20 of an indoor unit for an air-conditioning apparatus according to Embodiment 9 of the present invention. FIG. 15 is an illustration of a relationship between the fan air-outlet 7*d* and the end surface of the guide portion 11 when the air-sending portion 20 is viewed from the fan air-outlet 7*d* side. Next, with reference to FIG. 15, description is made of the indoor unit according to Embodiment 9 of the present invention.

In the guide portion 11 of the indoor unit according to Embodiment 9, when the air-sending portion 20 is viewed from the fan air-outlet 7*d* side, the upper guide 11*a* and the lower guide 11*b* each have an arc shape. Therefore, a curved surface is formed on each of the upper guide 11*a* and the lower guide 11*b*. The upper guide 11*a* and the lower guide 11*b* each have an arc shape so that the lateral portions of each of the upper guide 11*a* and the lower guide 11*b* are inclined in the upper-and-lower direction. The side regions are not completely covered by the inclined portions of each of the upper guide 11*a* and the lower guide 11*b* but are opened.

The upper guide 11*a* and the lower guide 11*b* may be equal to each other or different from each other in, for example, curvature and bending degree of the curved surfaces of the upper guide 11*a* and the lower guide 11*b*. Further, the shape of each of the curved surfaces is not particularly limited. Further, any one of the upper guide 11*a* and the lower guide 11*b* may have an arc shape.

As described above, in the air-conditioning apparatus according to Embodiment 9, there are provided the upper guide 11*a* and the lower guide 11*b* each having an arc shape inclined at the side regions. Thus, separation of an air stream on the side regions can be reduced. A pressure loss caused by turbulence of an air stream can be reduced so that improvement in efficiency and reduction in noise can be achieved due to improvement in air volume and static pressure effect. Further, a pressure loss can further be reduced so that improvement in efficiency and reduction in noise can be achieved due to improvement in air volume and static pressure effect.

Embodiment 10

Figure 16:
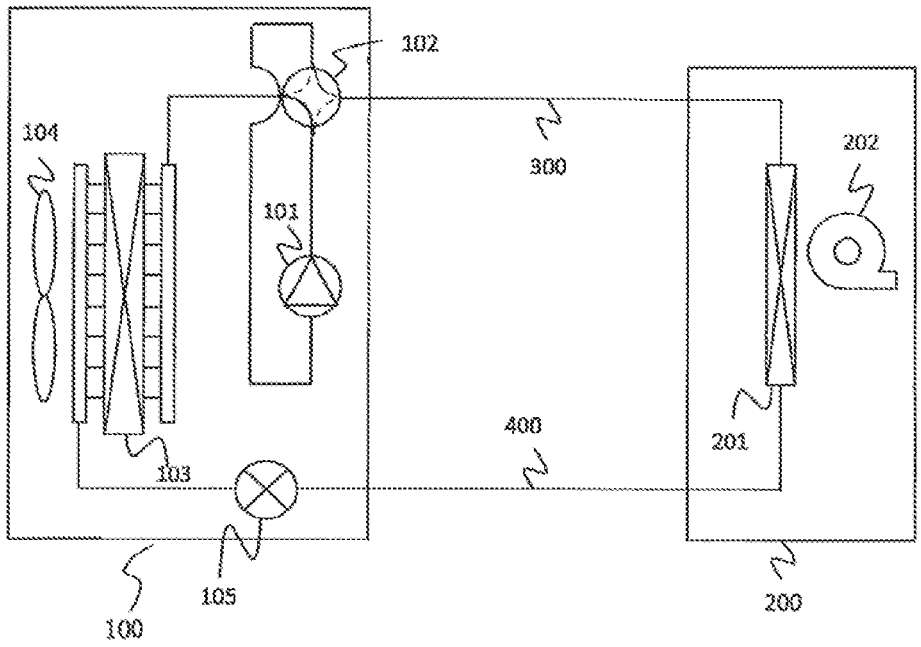
FIG. 16 is a view for illustrating a configuration of an air-conditioning apparatus according to Embodiment 10 of the present invention.

FIG. 16 is a view for illustrating a configuration of an air-conditioning apparatus according to Embodiment 10 of the present invention. In Embodiment 10, description is made of the air-conditioning apparatus including the indoor unit described in Embodiment 1 to Embodiment 9 described above. The air-conditioning apparatus in FIG. 16 includes an outdoor unit 100 and an indoor unit 200. The outdoor unit 100 and the indoor unit 200 are coupled to each other by refrigerant pipes to form a refrigerant circuit through which refrigerant flows. Among the refrigerant pipes, a pipe through which gas refrigerant flows is referred to as a gas pipe 300, and a pipe through liquid refrigerant (sometimes, two-phase gas-liquid refrigerant) flows is referred to as a liquid pipe 400.

The indoor unit 200 includes a load-side heat exchanger 201 and a load-side air-sending device 202. Similarly to the heat exchanger 6 in Embodiment 1 to Embodiment 9, the load-side heat exchanger 201 is configured to exchange heat between refrigerant and air. For example, the load-side heat exchanger 201 functions as a condenser during a heating operation. The load-side heat exchanger 201 is configured to exchange heat between refrigerant flowing in from the gas pipe 300 and air so that the refrigerant is condensed and liquified (or brought into a two-phase gas-liquid state), and to allow the refrigerant to flow out to the liquid pipe 400 side. Meanwhile, the load-side heat exchanger 201 functions as an evaporator during a cooling operation. The load-side heat exchanger 201 is configured to exchange heat between refrigerant brought into a low-pressure state by, for example, an expansion device 105 and air so that the refrigerant receives heat of the air to be evaporated and gasified, and to allow the refrigerant to flow out to the gas pipe 300 side.

Further, the indoor unit 200 includes the load-side air-sending device 202 configured to adjust flow of air in order to efficiently perform heat exchange between refrigerant and air. The load-side air-sending device 202 is a device having the same function as that of the air-sending portion 20 including, for example, the fans 3 in Embodiment 1 to Embodiment 9. The load-side air-sending device 202 is driven to rotate at a velocity determined, for example, through setting of air volume by a user.

Meanwhile, in Embodiment 10, the outdoor unit 100 includes a compressor 101, a four-way valve 102, an outdoor-side heat exchanger 103, an outdoor-side air-sending device 104, and the expansion device (expansion valve) 105.

The compressor 101 is configured to compress and discharge sucked refrigerant. The compressor 101 includes, for example, an inverter device so that a capacity of the compressor 101 (amount of refrigerant sent per unit time) can be finely changed by suitably changing an operating frequency. The four-way valve 102 is configured to switch flow of refrigerant during the cooling operation and flow of refrigerant during the heating operation based on an instruction from a controller (not shown).

Further, the outdoor-side heat exchanger 103 is configured to exchange heat between refrigerant and air (outdoor air). For example, the outdoor-side heat exchanger 103 functions as an evaporator during the heating operation. The outdoor-side heat exchanger 103 is configured to exchange heat between low-pressure refrigerant flowing in from the liquid pipe 400 and air so that the refrigerant is evaporated and gasified. Further, the outdoor-side heat exchanger 103 functions as a condenser during the cooling operation. The outdoor-side heat exchanger 103 is configured to exchange heat between refrigerant having been compressed in the compressor 101 and flowed in from the four-way valve 102 side and air so that the refrigerant is condensed and liquified. The outdoor-side heat exchanger 103 includes the outdoor-side air-sending device 104. Also in the outdoor-side air-sending device 104, a rotation speed of a fan may be finely changed by suitably changing an operating frequency of the fan motor 4 by an inverter device. Further, the air-sending portion 20 in Embodiment 1 to Embodiment 9 may be used as the outdoor-side air-sending device 104. The expansion device 105 is provided to adjust, for example, a pressure of refrigerant by changing an opening degree.

As described above, the air-conditioning apparatus according to Embodiment 10 includes the indoor unit described in Embodiment 1 to Embodiment 9. Thus, improvement in efficiency and reduction in noise can be attained due to improvement in air volume and static pressure effect.

Although the details of the present invention are specifically described above with reference to the preferred embodiments, it is apparent that persons skilled in the art may adopt various modifications based on the basic technical concepts and teachings of the present invention.

INDUSTRIAL APPLICABILITY

In Embodiment 1 to Embodiment 10 described above, application to the air-conditioning apparatus is described. However, the present invention is not limited to those apparatus, and may be applied to, for example, other refrigeration cycle apparatus such as a freezing machine or a water heater, which form a refrigerant circuit, and are configured to perform cooling, dehumidification, or humidification.

The invention claimed is:

1. An indoor unit, comprising:

an air-sending portion, which includes a casing having an air outlet and accommodating an impeller including a plurality of blades;

a heat exchanger, which is configured to exchange heat with gas sent from the air-sending portion; and a guide portion, which includes an upper guide defining a passage for the gas and being arranged between an upper edge portion of the air outlet and an upper end portion of the heat exchanger, and a lower guide defining a passage for the gas and being provided between a lower edge portion of the air outlet and a lower end portion of the heat exchanger, and which is open at side regions of the guide portion, wherein at least one of the upper guide and the lower guide has a curved shape curved to a lateral side and having an arc shape when viewed in a direction substantially parallel to a front-back direction of the air-sending portion.

2. The indoor unit of claim 1, wherein at least one of the upper guide and the lower guide includes a rib extending between the air outlet and the heat exchanger.

3. The indoor unit of claim 1, wherein at least one of the upper guide and the lower guide has a shape enlarged in a lateral direction and from the air outlet toward the heat exchanger.

4. The indoor unit of claim 1, wherein at least one of the upper guide and the lower guide includes an inclined portion inclined at an end portion in the lateral direction thereof.

5. The indoor unit of claim 1, wherein the upper guide of the guide portion comprises a curved wall that warps toward the upper end portion of the heat exchanger.

6. The indoor unit of claim 1, wherein the lower guide of the guide portion comprises a curved wall that warps toward the lower end portion of the heat exchanger.

7. The indoor unit of claim 1, further comprising:

a main body unit configured to accommodate the heat exchanger; and an air-sending unit configured to accommodate the air-sending portion, wherein the guide portion is mounted inside the main body unit.

8. The indoor unit of claim 1, wherein the casing of the air-sending portion comprises a plurality of casings that are arrayed in parallel with each other to face the heat exchanger.

9. The indoor unit of claim 8, wherein one upper guide and one lower guide are arranged for the plurality of casings.

10. An air-conditioning apparatus, comprising the indoor unit of claim 1.

11. An indoor unit, comprising:

an air-sending portion. which includes a casing having a rectangular air outlet and accommodating an impeller including a plurality of blades;

a heat exchanger, which is configured to exchange heat with gas sent from the air-sending portion; and a guide portion, which includes an upper guide defining a passage for the gas and being arranged between an upper edge portion of the air outlet and an upper end portion of the heat exchanger, and a lower guide defining a passage for the gas and being provided between a lower edge portion of the air outlet and a lower end portion of the heat exchanger, and which is open at side regions of the guide portion, wherein an upper edge portion of the air outlet is located below an upper end portion of the heat exchanger in an upper-and-lower direction, and the upper guide of the guide portion comprises a curved wall that warps toward the upper end portion of the heat exchanger; and wherein at least one of the upper guide and the lower guide has a curved shape curved to a lateral side and having an arc shape when viewed in a direction substantially parallel to a front-back direction of the air-sending portion.

12. An indoor unit, comprising:

an air-sending portion, which includes a casing having a rectangular air outlet and accommodating an impeller including a plurality of blades;

a heat exchanger, which is configured to exchange heat with gas sent from the air-sending portion;

and a guide portion, which includes an upper guide defining a passage for the gas and being arranged between an upper edge portion of the air outlet and an upper end portion of the heat exchanger, and a lower guide defining a passage for the gas and being provided between a lower edge portion of the air outlet and a lower end portion of the heat exchanger, and which is open at side regions of the guide portion, wherein a lower edge portion of the air outlet is located above a lower end portion of the heat exchanger in an upper-and-lower direction, and the lower guide of the guide portion comprises a curved wall that warps toward the lower end portion of the heat exchanger; and wherein at least one of the upper guide and the lower guide has a curved shape curved to a lateral side and having an arc shape when viewed in a direction substantially parallel to a front-back direction of the air-sending portion.

* * * * *